United States Patent [19]

Zeindler et al.

[11] 4,210,227

[45] Jul. 1, 1980

[54] APPARATUS FOR SELECTING A STOREY CALL AT AN ELEVATOR SYSTEM

[75] Inventors: Stephan Zeindler, Gunzwil; Hans G. Süss, Udligenswil, both of Switzerland

[73] Assignee: Inventio AG, Hergiswil, Switzerland

[21] Appl. No.: 972,890

[22] Filed: Dec. 26, 1978

[30] Foreign Application Priority Data

Jan. 17, 1978 [CH] Switzerland ..... 450/78

[51] Int. Cl.[2] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 3,519,106 | 7/1970 | Kirsch | 187/29 |
| 3,739,880 | 6/1973 | Robaszkiewicz | 187/29 |
| 4,113,066 | 9/1978 | Yoneda et al. | 187/29 |
| 4,166,518 | 9/1979 | Nakazato et al. | 187/29 |

*Primary Examiner*—Gene Z. Rubinson
*Assistant Examiner*—W. E. Duncanson, Jr.
*Attorney, Agent, or Firm*—Werner W. Kleeman

[57] ABSTRACT

An apparatus for selecting a storey call at a transportation installation, especially an elevator system, which contains storey call storages and a scanning device which continuously scans the storey call storages and produces a signal sequence containing the stored storey calls, as well as possessing a selector which signals the location of the elevator cabin. Upon coincidence of the elevator cabin location and the scanner position there is produced a coincidence signal which, in conjunction with an information signal signalling the operating state of the elevator cabin, is delivered to a selector circuit. Both signals act by means of a first NOR-gate and a storage upon a second NOR-gate of the selector circuit. Storey call signals which have been selected from the signal sequence produced by the scanner device and ordered in accordance with the time sequence of their input are delivered to a further input of the second NOR-gate. If there simultaneously appear the information signal signalling the travel readiness of the elevator cabin and the coincidence signal, then at the output of the second NOR-gate there appears a control signal which, in the direction of travel of the scanner device, corresponds to the storey call situated closest to the coincidence signal.

1 Claim, 7 Drawing Figures

APPARATUS FOR SELECTING A STOREY CALL AT AN ELEVATOR SYSTEM

BACKGROUND OF THE INVENTION

The present invention relates to a new and improved construction of transportation installation, and, more specifically, relates to apparatus for selecting a storey call at elevator systems or the like.

In its more particular aspects the invention relates to apparatus for selecting a storey call at elevator systems, which comprises storage elements controllable by means of storey call transmitters and storing the storey calls. The system further contains a scanner device which continuously scans in succession the storage elements from the lowermost to the uppermost and from the uppermost to the lowermost storey, the scanner device producing a signal sequence corresponding to the stored storey calls. Further, there is provided one selector which signals the location of at least one elevator cabin, and upon coincidence of the scanner position and the elevator cabin-position signal there is produced a coincidence signal.

In the case of collective controls for elevators it is known to accomplish the existing calls not in accordance with their input as a function of time, rather in a sequence dependent upon the position and the direction of travel of the elevator cabin. On the other hand, in the case of individual travel controls there is strived for servicing of the infed calls from the standpoint of the time of input thereof.

A heretofore known collective control for one or a number of elevators grouped together into a group, which collective control is formed of contactless switching elements and designed in digital technology, has been disclosed in Swiss Pat. No. 387,903. Such control system comprises a time-dependent and a position-dependent stepping mechanism. The time-dependent stepping mechanism controlled by a generator producing a sequence of 400 signals per second samples the storage elements serving for storage of the storey calls in succession form the lowermost to the uppermost and from the uppermost to the lowermost storey in a continuous fashion and delivers a signal train corresponding to the stored storey calls. The position-dependent stepping mechanism, during travel of the elevator cabin from one storey, in each case produces a signal corresponding to the following storey in an UP-direction or DOWN-direction, respectively. Now if the scanning position and the position signal of the elevator cabin coincide, then there is produced a coincidence signal. When the coincidence signal appears in conjunction with a signal, corresponding to a stored storey call, of the signal sequence or train delivered by the time-dependent stepping mechanism, then there is produced a holding signal which is delivered to the travel control of the elevator. In this way there is always selected and serviced the storey call situated closest to the position of the elevator cabin, thereby avoiding unnecessary idle travel of the elevator cabin.

A drawback of such type collective control particularly resides in the fact that even storey calls which have arrived at a later point in time may be serviced prior to earlier infed storey calls, so that there can arise unconscionably long waiting times at certain of the storeys of the building or structure.

A known apparatus for placing in order the servicing sequence of storey calls in not afflicted with this drawback. In this case there is provided a single travel control wherein there is extensively taken into account the sequence as a function of time of the input of the storey calls when they are serviced. This apparatus is provided for each storey with an additional storage element which is connected in circuit with a blocking and release device. A scanning device which scans the storage elements storing the storey calls controls the blocking and release device such that the storey calls are associated with timewise successive servicing stages. Thus, the storey calls which are infed during a servicing stage are blocked by means of the blocking device and only then serviced during the subsequent servicing stage after release by the blocking device.

The drawback of this apparatus resides in the fact that there can arise longer idle travel of the elevator cabin, since the storey calls are serviced independent of the position of the elevator cabin in accordance with the timewise sequence of input of the storey calls.

SUMMARY OF THE INVENTION

Therefore, with the foregoing in mind, it is a primary object of the present invention to provide an improved apparatus for selecting a storey call for elevator systems in a manner not associated with the aforementioned drawbacks and limitations of the prior art constructions as discussed above.

Another more specific object of the present invention aims at the provision of a new and improved construction of apparatus for selecting a storey call in a manner not associated with the drawbacks of the previously discussed equipment, rather extensively combines the advantageous features thereof.

Yet a further significant object of the present invention aims at the provision of a new and improved construction of apparatus for selecting a storey call at elevator systems in an efficient and rational manner, minimizing waiting times for individuals at the various storeys of a building or structure with which the elevator system is employed.

Now in order to implement these and still further objects of the invention, which will become more readily apparent as the description proceeds, the inventive apparatus is manifested by the features that there is provided a first NOR-gate or element, to whose first input there can be switched the coincidence signal and whose output is connected with the first input of a storage composed of two NOR-gates. The second inputs of the first NOR-gate and the storage are connected with one another and exhibit an information signal signalling the operating state of the elevator cabin and the doors. The output of the storage is connected with an input of a second NOR-gate. To the second input of the second NOR-gate there is delivered a signal sequence or train corresponding to the storey calls which have been released for servicing and which have been placed in order in accordance with the timewise sequence of their input. There is delivered to the third input of the second NOR-gate a signal sequence or train produced by a square wave generator. The storey calls which are still to be serviced and which are ordered in accordance with the timewise sequence of their input are first freed for servicing after there appears a continuous signal which signals the completion of all of the preceding storey calls, this continuous signal appearing at the second input of the second NOR-gate between two successive signals proudced by the scanner in each case upon scanning the lowermost storey in the UP-direction and appearing at the second input of the second NOR-gate as the storey call signal. Further, at the output of the second NOR-gate, upon simultaneous occurrence of the information signals signalling the standstill of the elevator cabin with closed doors and the coincidence signal at the inputs of the first NOR-gate, there is present a control signal, which in the direction of travel of the scanner, corresponds to the storey signal situated closest to the coincidence signal.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
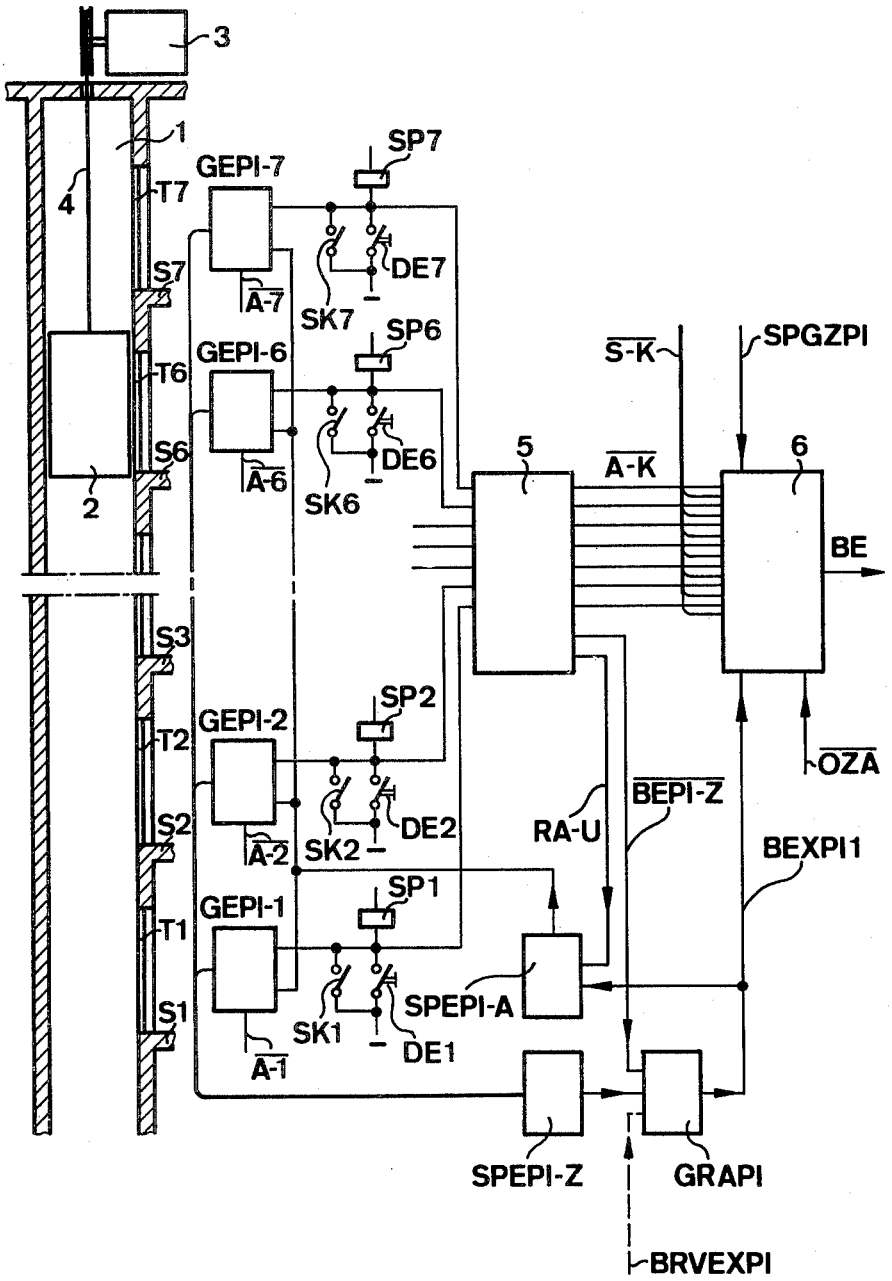
FIG. 1 is a schematic illustration of an elevator equipped with the inventive apparatus for selecting a storey call.

Describing now the drawings, in FIG. 1 reference character 1 designates an only partially illustrated elevator chute or shaft within which there is movably guided an elevator cabin 2. A conveyor or drive machine 3, controlled by a not particularly illustrated but conventional drive control, drives by means of a conveyor cable 4 the elevator cabin 2. According to the exemplary embodiment the elevator cabin 2 services, by way of example and not limitation, seven storeys S1 to S7 of a building or the like. Reference characters T1 to T7 constitute hoistway doors which are arranged at such storeys or floors S1 to S7, respectively. Storage elements SP1 to SP7, for instance in the form of electromagnetic relays, serving to store the storey calls are operatively associated with the storeys or floors S1 to S7, respectively. These storage elements SP1 to SP7 are controlled by means of storey call transmitters DE1 to DE7 arranged at the storeys S1 to S7, respectively. Connected in parallel with the storey call transmitters DE1 to DE7 are the self-holding contacts SK1 to SK7, respectively, by means of which a potential is applied to the relays SP1 to SP7. Reference character 5 designates an electronic scanner which in the manner of Swiss Pat. No. 387,903, the disclosure of which is incorporated herein by reference, can be constructed in the form of a known time-dependent stepping mechanism composed of digital elements and having seven inputs connected with the storage elements SP1 to SP7 and seven outputs operatively associated with the individual storeys S1 to S7. The electronic scanner or feeler 5, operating at a scanning frequency of for instance 1000 Hz, scans the storage elements SP1 to SP7 continuously in succession from the lowermost to the uppermost storey S1 and S7 and from the uppermost storey to the lowermost storey S7 to S1, and thereby produces a signal sequence or train corresponding to the infed storey calls and in each case produces a further signal upon scanning the first storey S1 in the UP-direction.

Continuing, a further storage element GEPI-1 to GEPI-7 is operatively associated with each storey S1 to S7. The first input of each such further storage GEPI-1 to GEPI-7 is connected with the related relay SP1 to SP7 serving for the storage of a storey call and with the relevant input of the electronic scanner or feeler 5. A further input of the storage elements GEPI-1 to GEPI-7 is connected with the related output of the scanner 5. The outputs of the storage elements GEPI-1 to GEPI-7 are connected with the inputs of an OR-gate SPEPI-Z. The output of the OR-gate SPEPI-Z is connected with the first input of a NOR-gate forming a blocking device GRAPI, the second input of which is connected with the output of the electronic scanner 5 which delivers the signal sequence or train corresponding to the storey calls and the output is connected with a selection circuit 6 which will be explained more fully hereinafter in conjunction with the description of FIG. 2.

A release device SPEPI-A consists of a univibrator, a storage, a NOT-gate and an output-NOR-gate or element. The input of the univibrator is connected by means of a NOT-element or gate with the first input of the output-NOR-gate and with the output of the scanner 5 which delivers the signal arising during scanning of the first storey S1 in the UP-direction. Its output is connected with the first input of the storage, the second input of which is connected with the output of the blocking device GRAPI. The output of the storage is connected with the second input of the output-NOR-element or gate, whose output is connected with the second inputs of the further storage elements GEPI-1 to GEPI-7.

Figure 3:
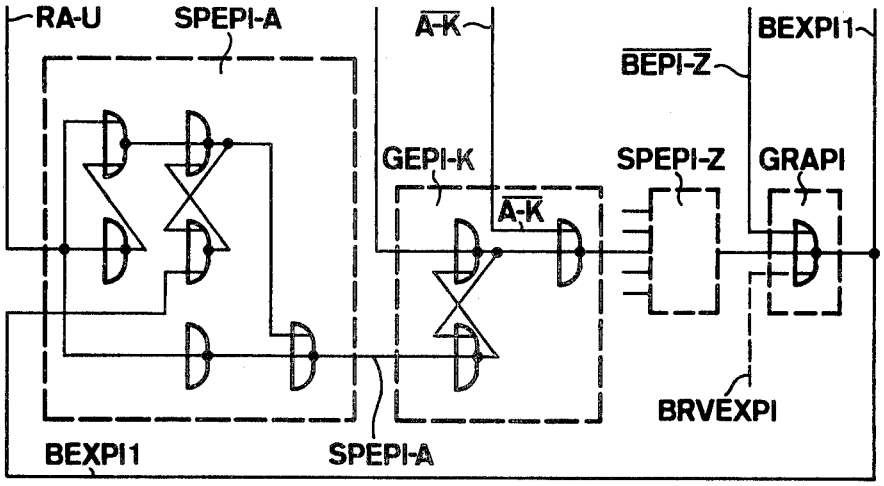
FIG. 3 is a detailed circuit diagram of a device, contained in the apparatus of FIG. 1, serving to order the servicing sequence of the storey calls as a function of time.

The further storage elements GEPI-1 to GEPI-7, the OR-element SPEPI-Z, the blocking device GRAPI and the release device SPEPI-A are components which are illustrated in greater detail in FIG. 3 of an apparatus described in our commonly assigned, copending U.S. application Ser. No. 957,335, filed Nov. 2, 1978, to which reference may be had and the disclosure of which is incorporated herein by reference, and by means of which the infed storey calls are ordered in timewise successive servicing stages. In so doing in each case the storey calls which are infed during a servicing stage are blocked by means of a blocking device GRAPI and first serviced during the subsequent servicing stage, following release by the release device SPEPI-A.

Figure 2:
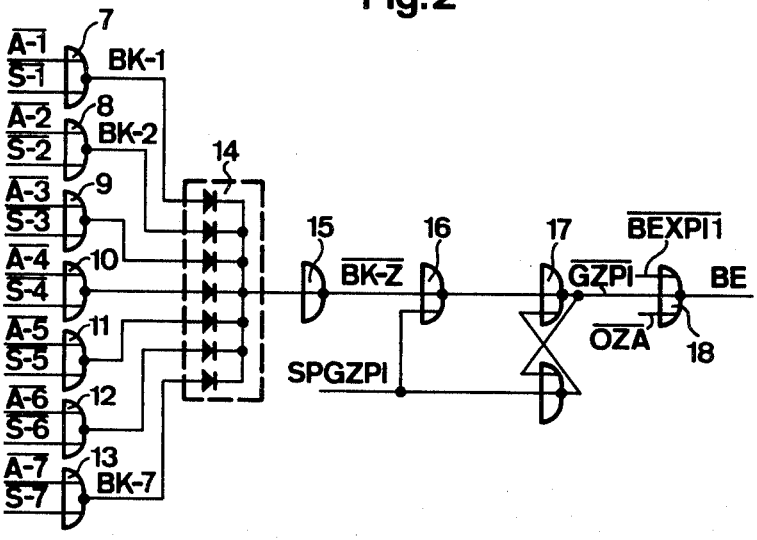
FIG. 2 is a detailed circuit diagram of a selector circuit of the apparatus of FIG. 1.

In FIG. 2 reference characters 7 to 13 designate seven NOR-gates which are operatively associated with the individual storeys S1 to S7. The first inputs of the NOR-gates 7 to 13 are connected with the seven corresponding outputs of the electronic scanner 5 and their second inputs with the outputs, corresponding to the individual storeys, of a further not particularly illustrated selector which signals the position of the elevator cabin 2. The outputs of the NOR-gates or elements 7 to 13 are connected with the inputs of an OR-element or gate 14 composed exclusively of diodes and a NOR-circuit composed of a NOT-element 15, whose output is connected by means of a NOR-element 16 having two inputs, with an input of a storage 17 formed in conventional manner of two NOR-elements. The second inputs of the further NOR-gate 16 and the storage 17 are connected with one another and with the not particularly illustrated and described travel control of the elevator system, from which they receive an information signal which signals one of the operating states of the elevator cabin 2 and the doors T1 to T7. The output of the storage 17 is connected with an input of a NOR-element or gate 18 having three inputs, wherein there is delivered to the second input thereof an oscillator signal produced by means of a not particularly further illustrated square wave generator. The third input is connected with the output of the blocking device GRAPI and carries the signal sequence corresponding to the storey calls which are released for servicing. At the output of the NOR-gate or element 18 there appears a control signal corresponding to the storey call located closest to the elevator cabin 2, this control signal serving in conventional and therefore not particularly illustrated manner for the travel control of the elevator.

Figure 4:
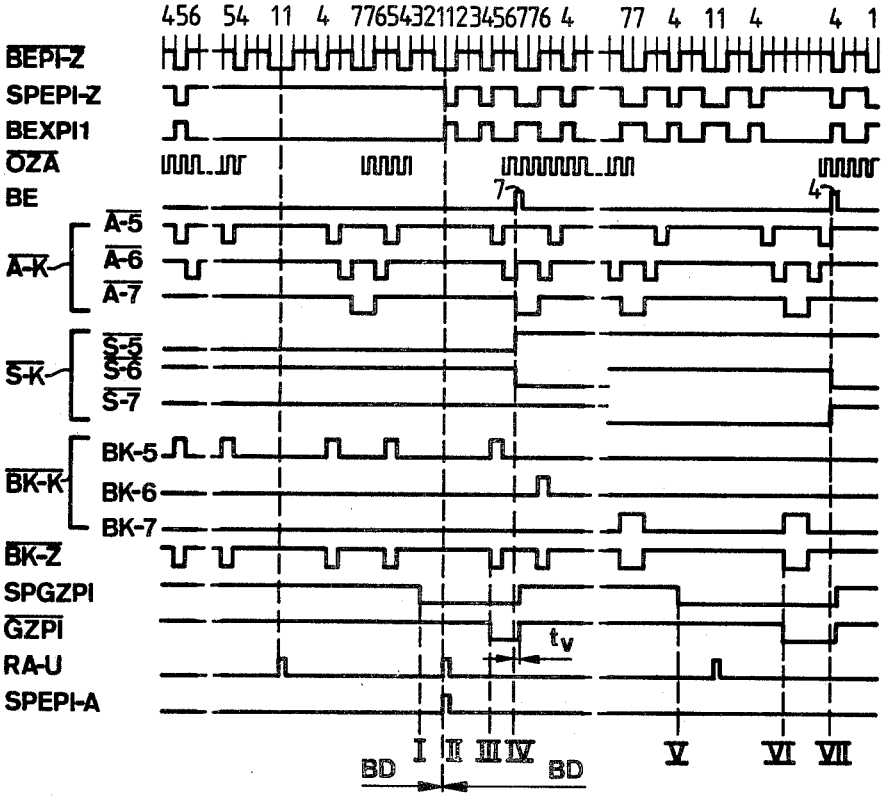
FIG. 4 is a graph showing the course as a function of time of the signal trains or sequences appearing at the different inputs and outputs of the apparatus of the invention.

In FIG. 4 the following symbols have the following meanings:

$\overline{\text{BEPI-Z}}$—The signal train or sequence corresponding to the infed storey calls produced by the electronic scanner 5, wherein $\overline{\text{BEPI-Z}}=0$ corresponds to a stored storey call;

SPEPI-Z—The signal train present at the output of the OR-element SPEPI-Z and at the input of the blocking device GRAPI;

BEXPI1—The signal train present at the output of the blocking device GRAPI, wherein BEXPI1=1 corresponds to a storey call which is released for servicing;

$\overline{\text{OZA}}$—The signal train delivered by a square wave generator the frequency of which is equal to the scanning or sampling frequency of the scanner 5;

BE—The signal train present at the output of the selector circuit 6, whose signals BE=1 correspond to the storey calls situated closest to the elevator cabin 2 in each case in the direction of travel of the scanner;

$\overline{\text{A-K}}$—A signal produced by the scanner 5 which in each case is null during scanning the relevant storey;

$\overline{\text{S-K}}$—The position signal of the elevator cabin 2 which is delivered by the selector;

BK-K—The signal appearing at the input of the NOR-circuit 14/15;

$\overline{\text{BK-Z}}$—The coincidence signal appearing at the output of the NOR-circuit 14/15, wherein $\overline{\text{BK-Z}}=0$ when the scanner and selector position coincide;

SPGZPI—An information signal delivered by the elevator control, wherein SPGZPI=0 signifies standstill of the elevator cabin 2 with closed doors;

$\overline{\text{GZPI}}$—The information or signal appearing at the output of the storage 17;

RA-U—The signal produced in the UP-direction by the scanner 5 in each case upon scanning the first storey S1;

SPEPI-A—The signal appearing in each case at the start of a servicing stage at the output of the release device SPEPI-A, and BD—The duration of a servicing stage or period.

The prevailing signals or information, as is conventional for the designation of logical states in the case of digital circuits, can assume the logical values or states "1" and "0". In the subsequent functional description there is thus likewise used the designation logic signal "1" or logic signal "0", and there can be understood, as is usual, also the presence of a voltage or potential or no voltage or potential, respectively. Instead of the designation "signal sequence or train" there is also employed the designation "band". The reference character "K" in the information signals $\overline{\text{A-K}}$, $\overline{\text{S-K}}$ and BK-K stands for the numerals 1 to 7 of the related storeys or floors.

The previously described apparatus operates in the following manner:

It is assumed that the elevator cabin 2, in response to a cabin call, has terminated its travel to the storey or floor S5, the doors T1 to T7 are closed and there is not stored any further cabin call, so that there is present the information signal SPGZPI=0 (time point I, FIG. 4). Furthermore, at this moment of time the scanner and selector positions do not coincide, so that there is not present any coincidence ($\overline{\text{BK-Z}}=1$) and the outputs of the storage 17 and the NOR-gate 18 carry the information signals $\overline{\text{GZPI}}=1$ and BE=0 (FIG. 2). During the further course of the scanning operation there is attained the scanning position correlated to the storey or floor S1 and upon the start of a new work cycle in the UP-direction there is produced by the scanner 5 the information signal RA-U=1. Now if between this information signal and the preceding information signal RA-U=1 the band BEXPI1 does not possess any storey call BEXPI1=1 released for servicing, then there is initiated a new servicing stage BD (time point II, FIG. 4). Consequently, the following operations occur in the release device SPEPI-A (FIG. 3): the preceding information or signal RA-U=1 produces at the output of the univibrator a brief logic signal "1", so that at the output of the storage and at the second input of the output-NOR-gate there appears a logic signal "0". The following information signal RA-U=1 (time point II) is inverted and arrives at the first input of the output-NOR-element, so that there is present at its output an information or signal SPEPI-A=1. It is now assumed that during the preceding servicing stage BD there are infed calls for the storeys S1, S7 and S4 and blocked by means of the blocking device GRAPI. Since SPEPI-A=1 there are now flipped-over the storages GEPI-1, GEPI-7, GEPI-4 and the stored storey calls are released for servicing. They appear at the bands SPEPI-Z and BEXPI1 as the information signals SPEPI-Z=0 and BEXPI1=1, respectively (FIG. 4).

Upon attaining the scanning position correlated to the storey S5, since the selector still signals the standstill of the elvator cabin 2 at the storey S5, and with the information $\overline{\text{A-5}}=0$ and $\overline{\text{S-5}}=0$ at the input and BK-5=1 at the output of the NOR-gate 11, the coincidence signal at the output of the NOR-circuit 14/15 becomes $\overline{\text{BK-Z}}=0$. Since SPGZPI still assumes the logic state "0" the information signal at the output of the storage 17 assumes the condition $\overline{\text{GZPI}}=0$ (time point III, FIG. 4 and FIG. 2).

During the further course of the scanning operation there is attained the scanning position correlated to the storey or floor S7 (time point IV, FIG. 4). Since for this storey S7 there is stored a call and released for servicing (BEXPI1=1), there appears at the second input of the NOR-element 18 which is connected by means of a not particularly illustrated NOT-element with the output of the blocking device GRAPI, an inverted information signal $\overline{\text{BEXPI1}}=0$. Since at the same time there appears at the third input of this NOR-element a signal $\overline{\text{OZA}}=0$ of the square wave generator-signal sequence $\overline{\text{OZA}}$ which is synchronous to the scanner-signal sequence $\overline{\text{BEPI-Z}}$, the output of the NOR-element 18 carries the information signal BE=1 which is delivered as a control signal to the travel control of the elevator (FIG. 2). The signal $\overline{\text{OZA}}=0$ and thus the control signal BE=1 is half as wide as the signal $\overline{BEXPI1}=0$, so that there is avoided any overlapping of two neighboring storey calls.

Due to the control signal BE=1 the elevator cabin 2 begins to move in the direction of the storey S7, and the selector switches to the storey S6 (time point IV, FIG. 4). The information signals SPGZPI and $\overline{GZPI}$ first change after a switching-governed delay time $t_v$ after this time point from the logic state "0" to the logic state "1". During the travel to the storey S7 there appear at the band BE, due to the information signal SPGZPI=1, no further storey signals. Now it is assumed that after stopping at the storey S7 (time point V, FIG. 4) the elevator cabin 2 is not used. In this case there occur at the times IV, VI, VII the same procedures as at the times I, III and IV, and there is selected the call stored for the storey S4 and the elevator cabin 2 begins to move in the direction of this storey.

As previously mentioned, the band BE, during the travel of the elevator cabin 2, does not contain any storey call. During this time there is superimposed a cabin call band upon the storey call band BE, by known and therefore not further described circuit means, which contain the control signals corresponding to the infed cabin calls and serving for the travel control of the elevator.

Figure 5:
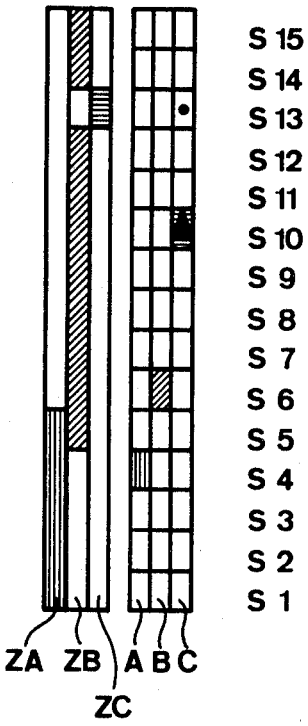
FIGS. 5, 6 and 7 schematically illustrate a group of elevators equipped with the inventive apparatus and showing the same at three different points in time.
Figure 6:
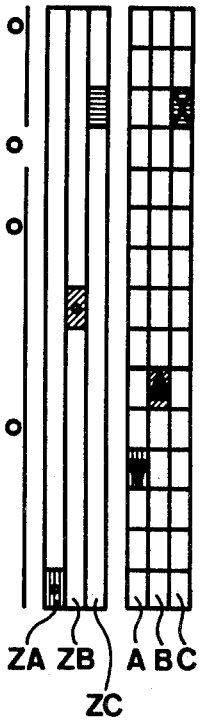
Figure 7:
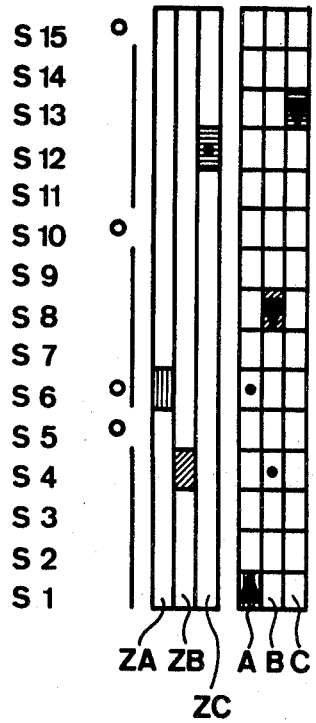

The apparatus described previously for use in conjunction with an elevator system can also be employed with a group of elevators, as demonstrated in the subsequent description accompanying FIGS. 5 to 7. Here the scanner 5 as well as the devices for the timewise ordering or arranging of the infed storey calls composed of the elements GEPI, SPEPI-Z, GRAPI and SPEPI-A, are common to all of the elevators of the group. On the other hand, each individual elevator of the group has operatively associated therewith a selector circuit 6 which in each case selects that storey call among the infed and timewise ordered storey calls which have the shortest spacing from the relevant elevator cabin in the UP-direction or DOWN-direction. The selector circuits 6 are connected at the input side with the with the common scanner 5 and the related selector.

In FIGS. 5 to 7 there have been designated by reference characters A, B and C three elevator cabins of an elevator group servicing for instance 15 storeys S1 to S15. Reference characters ZA, ZB and ZC designate variable call allocation zones which are correlated to each elevator cabin. The symbols employed in FIGS. 5 to 7 have the following meaning:

▼ ▲ elevator cabin in direct travel

□ elevator cabin ready for servicing storey calls

⊠ elevator cabin occupied, doors open

• a cabin call

○ a storey call

⊡ a correlated storey call and

| call allocation blocked.

At the time $t_1$ (FIG. 5) the elevator cabins A and B are free. Their call allocation zones ZA and ZB extend from the cabin position in the UP-direction and DOWN-direction up to the position of the next elevator cabin which is ready to service the storey calls or up to the end of the elevator cabin chute, respectively. The elevator cabin C services in direct travel the cabin call for the storey S13. It reserves the storey call servicing at the target storey. This means that the call allocation zone ZC is only correlated to this storey, so that a storey call which is possibly present for this storey is only serviced by the elevator C. This occurs in that a storey call-reservation band BRVEXPI containing all of the stored cabin calls and produced in a not further llustrated manner is infed to a third input of the blocking device GRAPI (FIGS. 1, 3) so that with the signals BRVEXPI=1, $\overline{BEPI\text{-}Z}=0$ and SPEPI-Z=0 the information signal at the output of the blocking device GRAPI becomes $\overline{BEXPI1}=0$, whereby there is suppressed the storey call for the storey S13 contained in the band BEXPI1 and no longer can be allocated to the zones ZA and ZB.

At a later point in time $t_2$ (FIG. 6) there may be freed for servicing three storey calls for the storeys S1, S8 and S12 by the release device SPEPI-A, whereupon the elevator cabin A travels to the first storey and the elevator cabin B to the eighth storey. The call for the storey S12 cannot yet be allocated, since it is assumed that the door T13 is still open at the elevator cabin C which has arrived in the meantime. Since this storey call is still located in the band BEXPI1, the servicing stage BD for the calls correlated to the storeys S1, S8 and S12 thus has not yet been completed, the storey calls for the storeys S5, S10 and S15 which have been infed in the meantime are still blocked and cannot yet be allocated or serviced, as the case may be.

At a further point in time $t_3$ (FIG. 7) following the time $t_2$ there occurs the allocation of the storey call for the storey S12, so that the elevator cabin C travels from the storey S13 to the storey S12. Consequently, there is completed a servicing stage BD and the storey call for the storeys S5, S10 and S15 are freed for servicing by the release device SPEPI-A. However, initially the elevator cabin B completes a cabin call for the storey S4 and the elevator cabin A a cabin call for the storey S6, and there is serviced a storey call which is simultaneously present at this storey, although this does not belong to the servicing stage BD which is in progress.

While there are shown and described present preferred embodiments of the invention, it is to be distinctly understood that the invention is not limited thereto, but may be otherwise variously embodied and practiced within the scope of the following claims. Accordingly,

What we claim is:

1. In an apparatus for selecting a storey call at an elevator system, comprising:

storage elements for storing the storey calls;

storey call transmitters for controlling the storage elements;

a scanner device for successively continuously scanning the storage elements from the lowermost storey to the uppermost storey and from the uppermost storey to the lowermost storey;

said scanner device producing a signal sequence corresponding to the stored storey calls;

at least one selector means for signalling the position of at least one elevator cabin;

upon coincidence of the scanner position and the elevator position-signal there being produced a coincidence signal;

the improvement comprising;

a first NOR-element having a first input, a second input and an output;

a storage composed of two NOR-elements;

said storage having a first input, a second input and an output;

the first input of the first NOR-element being capable of carrying the coincidence signals;

the output of the first NOR-element being connected with the first input of the storage;

the second inputs of the first NOR-element and the storage being connected with one another and carrying an information signal characterizing the operating state of the elevator cabin and the doors;

a second NOR-element having a first input, a second input, a third input and an output;

the output of the storage being connected with the first input of the second NOR-element;

the second input of the second NOR-element carrying a signal train which has been placed in order in acccordance with the timewise sequence of the storey call inputs for servicing released storey calls;

the third input of the second NOR-element receiving a signal train produced by a square wave generator;

the storey calls still to be serviced and which have been ordered in accordance with the timewise sequence of their input first being freed for servicing after a continuous signal which signals the completion of all preceding storey calls appears at the second input of the second NOR-gate and extends between two successive signals produced by the scanner device in each case upon scanning the lowermost storey in the UP-direction;

said continuous signal appearing at the second input of the second NOR-gate as the storey call signal;

a control signal appearing at the output of the second NOR-element after simultaneous occurrence of the information signal and the coincidence signal at the inputs of the first NOR-gate and which information signal signals the standstill of the elevator cabin with closed doors; and said control signal corresponding to the storey call signal situated closest to the coincidence signal in the direction of travel of the scanner device.

* * * * *